US008056779B1

(12) United States Patent
Brunwin

(10) Patent No.: US 8,056,779 B1
(45) Date of Patent: Nov. 15, 2011

(54) DEVICE FOR CARRYING TODDLERS AND SMALL CHILDREN ON AN ADULT WEARER'S BACK

(76) Inventor: Robert Brunwin, San Francisco, CA (US)

( * ) Notice: Subject to any disclaimer, the term of this patent is extended or adjusted under 35 U.S.C. 154(b) by 498 days.

(21) Appl. No.: 12/315,990

(22) Filed: Dec. 9, 2008

(51) Int. Cl.
*A47D 13/02* (2006.01)

(52) U.S. Cl. ..... 224/160; 224/161

(58) Field of Classification Search ..... 224/160, 224/161
See application file for complete search history.

(56) References Cited

U.S. PATENT DOCUMENTS

| | | | | |
|---|---|---|---|---|
| 652,352 | A | 6/1900 | Doell | |
| 4,009,808 | A * | 3/1977 | Sharp | 224/160 |
| 4,848,067 | A | 7/1989 | Martinsen | 54/44 |
| 4,901,898 | A | 2/1990 | Colombo et al. | 224/159 |
| 4,915,277 | A | 4/1990 | Larreategui | 224/159 |
| 4,993,612 | A | 2/1991 | Quimby, Sr. et al. | 224/160 |
| 5,205,450 | A | 4/1993 | Derosier | 224/161 |
| 5,441,186 | A | 8/1995 | Halligan | 224/159 |
| 5,609,279 | A * | 3/1997 | O'Shea | 224/160 |
| 5,692,655 | A | 12/1997 | Fair et al. | 224/160 |
| 5,868,292 | A * | 2/1999 | Stephens et al. | 224/161 |
| 6,098,856 | A * | 8/2000 | Reilly | 224/160 |
| 6,345,745 | B1 | 2/2002 | Harriss | 224/158 |
| 2005/0051582 | A1 * | 3/2005 | Frost | 224/160 |
| 2009/0206116 | A1 * | 8/2009 | Grant | 224/160 |

FOREIGN PATENT DOCUMENTS

DE 3916370 A1 * 11/1990

* cited by examiner

*Primary Examiner* — Brian D Nash
(74) *Attorney, Agent, or Firm* — Goldstein Law Offices P.C.

(57) ABSTRACT

A device for carrying a child piggyback upon an adult wearer, having a back plate which is positioned against the lower back of the adult wearer. A saddle extends rearwardly from the back plate for holding a seated child. A waist belt extends from the back plate and around the waist of the adult wearer. Stirrups hold the feet of the child and are supported from the waist belt. Major shoulder straps, each having an apex, extend from the back plate and extend over the shoulders of the adult wearer. A mid belt extends horizontally around both the adult wearer and child. Minor shoulder straps extend from the mid belt, over the shoulders of the child, and are attached near the apex of the major shoulder straps to hold the child securely in place against the back of the adult.

12 Claims, 3 Drawing Sheets

DEVICE FOR CARRYING TODDLERS AND SMALL CHILDREN ON AN ADULT WEARER'S BACK

BACKGROUND OF THE INVENTION

The invention relates to device for carrying toddlers and small children. More particularly, the invention relates to a device, which is worn by a wearer, and permits a toddler or small child to safely and comfortably ride "piggyback" on an adult wearer's back, while well supported thereon.

At the earliest stages of development, children are incapable of locomotion. Accordingly, infant carriers and the like have been devised to comfortably and safely support an infant, while providing a handle for the parent to safely carry the infant from location to location, with one hand. At a certain point, however, it becomes difficult for a parent to carry the baby with such one-handed carrying. Accordingly, infant/baby carriers are designed with a maximum capacity that generally ranges from 20-40 pounds.

As children progress with their development, they begin to crawl, and then eventually to walk. Once a child can walk, the parent's preference (and often the child's as well) is to walk from place to place. Young children, however, quickly grow tired. Even a trip to the store can be too much walking for a beginner.

The most common solution to transporting a small child, with limited walking range, is to use a stroller. Strollers are bulky and cumbersome. They are difficult to travel with, and quickly become a liability when the child suddenly decides to walk instead of riding.

Most devices that have been proposed are suitable for carrying an infant, or a very small child. Few options are available, however, to carry a child that is greater than 40 pounds, or more than 2 years old.

Devices are available for carrying an infant on the front (against the belly) of the wearer. For example U.S. Pat. No. 5,205,450 to Derosier discloses a child carrier that holds the baby in sling in either a facing-in or facing-out position. U.S. Pat. No. 5,692,655 to Fair et al, on the other hand, discloses a soft carrier for holding a baby on the back of the wearer.

U.S. Pat. No. 4,915,277 to Larreategui discloses a child carrier that holds the hold on the side of the wearer—supported by the hip of the wearer. Similarly, U.S. Pat. No. 5,441,186 to Halligan discloses a side saddle holster, which allows a very small child to be supported at the hip of the wearer. U.S. Pat. No. 4,848,067 to Martinson discloses a novelty saddle for entertainment purposes, which allows a child to be carried by an infant while on all fours.

U.S. Pat. No. 6,345,745 to Harriss discloses a child carrier, which basically consists of a belt for the wearer, and a set of stirrups. Harriss is at best suitable for a much older child—since there are no safety devices—and Harriss relies on the child holding on to the wearer. Similarly U.S. Pat. No. 4,901,898 to Colombo et al. discloses a waist mounted infant carrier which merely supports the infant's bottom near the waist of the wearer, but relies on the wearer to prevent the infant from falling.

U.S. Pat. No. 4,993,612 to Quimby, Sr. et al, discloses a portable back carrier, for carrying a person. With this device, the child is rather uncomfortably supported by a series of strap.

U.S. Pat. No. 652,352 to Doell describes a device intended for use by firefighters to carry a person on their back.

While these units may be suitable for the particular purpose employed, or for general use, they would not be as suitable for the purposes of the present invention as disclosed hereafter.

SUMMARY OF THE INVENTION

It is an object of the invention to produce a carrier that allows a toddler or small child to be comfortably and safely carried on the back of a parent or other adult wearer. Accordingly, the carrier is configured with a saddle to support the child, and straps which both hold the carrier in place on the wearer and keep the child secure.

It is another object of the invention to provide s carrier which holds the child in a well-secured position. Accordingly, the saddle prevents the child from sliding backwards, a mid belt extends around the mid section of the child and holds the child against the wearer's back, and a pair of stirrups prevent the child's feet from dangling.

It is a further object of the invention to provide a carrier which is easy to don by the adult wearer, and easy to secure the child thereupon. Accordingly, the simple strap system allows the system to be fully operational in a matter of seconds.

It is yet a further object of the invention to allow the adult wearer to carry the child for a considerable distance without fatigue or injury. Accordingly, a back plate acts as a focal point for the stresses and forces exerted by the child upon the device, and helps effectively distribute the child's weight among the shoulders, waist, and lower back.

The invention is a device for carrying a child piggyback upon an adult wearer, having a back plate which is positioned against the lower back of the adult wearer. A saddle extends rearwardly from the back plate for holding a seated child. A waist belt extends from the back plate and around the waist of the adult wearer. Stirrups hold the feet of the child and are supported from the waist belt. Major shoulder straps, each having an apex, extend from the back plate and extend over the shoulders of the adult wearer. A mid belt extends horizontally around both the adult wearer and child. Minor shoulder straps extend from the mid belt, over the shoulders of the child, and are attached near the apex of the major shoulder straps to hold the child securely in place against the back of the adult.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
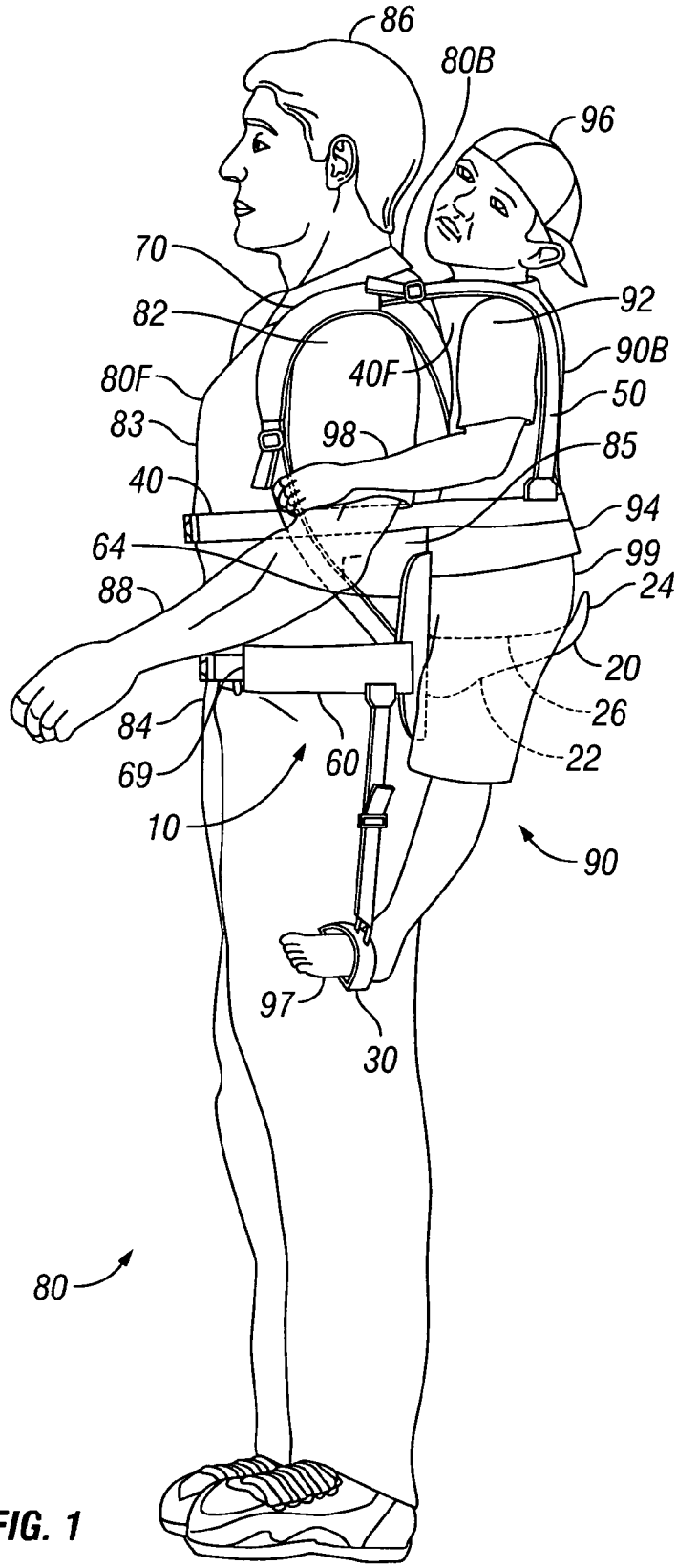
FIG. 1 is a side elevational view, illustrating the carrying device being worn by an adult, wherein a child is safely supported thereby.

FIG. 1 illustrates an adult wearer 80, wearing a carrying device 10 according to the present invention. The carrying device 10 is being used to support and secure a child 90 in a "piggyback" fashion with respect to the adult wearer 80. The adult has a front 80F, a back 80B, shoulders 82, an abdomen 83, a waist 84, a lower back 85, a head 86, and arms 88. The child 90 has a front 90F, a back 90B, shoulders 92, a waist 94, a head 96, feet 97, arms 98 and a seat 99. Note that as used herein, "adult" and "child" can be broadly defined as larger and smaller persons, suitably sized for using the device according to the present invention as indicated in the description and accompanying drawing figures. For example, the adult wearer could be a teenager, carrying a younger child. In addition, both the adult wearer 80 and child 90 illustrated in the accompanying drawings are male, and thus the description is written consistently therewith. Clearly, however the use of the present invention as described herein applies equally well to either gender.

As illustrated in FIG. 1, the carrying device 10 has a saddle 20 and stirrups 30. The seat 98 of the child is resting upon and supported by the saddle 20, and his feet 97 extend within and are supported by the stirrups 30. The front 90F of the child 90 is resting against the back 80B of the adult wearer 80. A mid belt 40 extends around the waist 94 of the child, and also extends around the abdomen 83 of the adult wearer 80. A pair of minor shoulder straps 50 extend from the mid belt 40, upwardly along the back 90B of the child 90, and over the shoulders 92 of the child 90.

Further illustrated in FIG. 1, a waist belt 60 extends around the waist 84 of the adult wearer 80, and a back plate 64 attached thereto rests against the lower back 85 of the adult wearer 80. A pair of major shoulder straps 70 extend along the back 80B of the adult wearer, over the shoulders 82 of the adult wearer 80, and then cut under the arms 88 of the adult wearer to secure to the back plate 64. As indicated, after extending over the shoulders 92 of the child 90, the minor shoulder straps 50 secure to the major shoulder straps 70.

Figure 2:
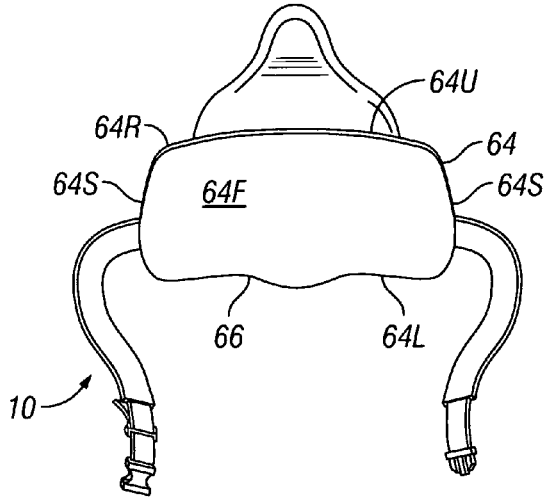
FIG. 2 is a diagrammatic perspective view illustrating just the back plate, saddle, and waist belt, wherein the major and minor shoulder straps and mid belt have been removed for clarity.

Referring now to FIG. 2, the back plate 64 has a front 64F, a back 64B, an upper edge 64U, a lower edge 64L, and a pair of side edges 64S. The back plate 64 also has a sacrum extension 66 which extends downwardly from the lower edge 64L, provides additional support further down the lower back of the adult wearer. Note that the back plate 64 is preferably made of a semi-rigid plastic material that is strong and rigid enough to receive and distribute a large portion of the stresses generated by support of the child on the saddle, such that the back plate 64 acts as a focal points for receiving and distributing the forces and stresses occurring when the weight of the child is fully supported upon the device 10.

Figure 3:
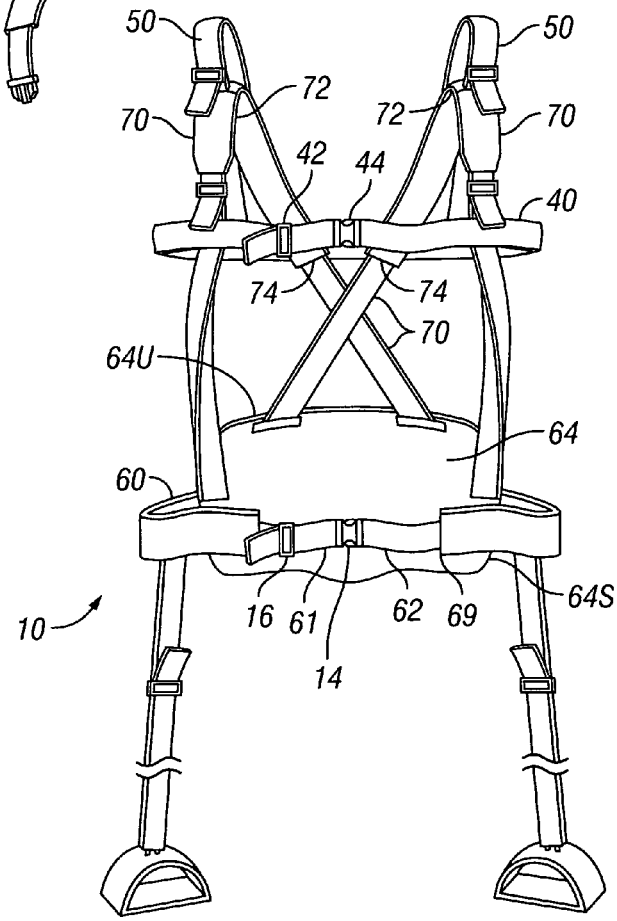
FIG. 3 is a front elevational view, illustrating the carrying device, with the straps fastened.

Accordingly, referring to FIG. 3, the major shoulder straps 70 have a pair of ends that are both attached to the back plate 64. In particular, the major shoulder straps 70 are attached near the upper edge 64U of the back plate 64, cross each other above the back plate 64, and have an apex 72 near where they are attached to the minor shoulder straps 50. After extending over the shoulders of the wearer 80 at their apexes 72 (as seen in FIG. 1), the major shoulder straps 70 descend to once again attach to the back plate 64 at the sides 64S. The crossing of the major shoulder straps 70 allows the weight to be distributed more evenly on the adult wearer, such that if the child leans toward one side, the stress will be partially translated to an opposite shoulder of the adult. To further aid weight distribution on the adult wearer 80, each of the shoulder straps has an outer padded sleeve 74, near the apex 72. The outer padded sleeve 74 helps to increase the weight distribution and comfort to the shoulders 82 of the adult wearer 80. To help adjust and secure the device 10 on adult wearers 80 of different sizes, each of the major shoulder straps 70 has an adjustment buckle 76.

The waist belt 60 extends at least partially around the outside of the back plate 64 and is secured at the rear 64R thereof. The waist belt 60 has a pair of ends 61, 62, a mateable buckle 14, and an adjustment buckle 16. The adjustment buckle 16 can be used to adjust an overall length of the waist belt 60 to allow it to accommodate different sized adult wearers 80. The mateable buckle 14 has two portions, each connected to one of the ends 61, and 62, to allow the ends 61, 62 to be selectively attached to secure the waist belt 60 around the waist of the wearer, and detached to remove the waist belt (and the device 10) from the wearer. When the mateable buckle 14 is attached, and the adjustment buckle 16 suitably adjusted, the waist belt holds the back plate 64 firmly against the lower back 85 of the adult wearer 80, as shown in FIG. 1. The waist belt has an outer padded sleeve 69, which helps to increase the weight distribution and comfort to the adult wearer 80.

Figure 4:
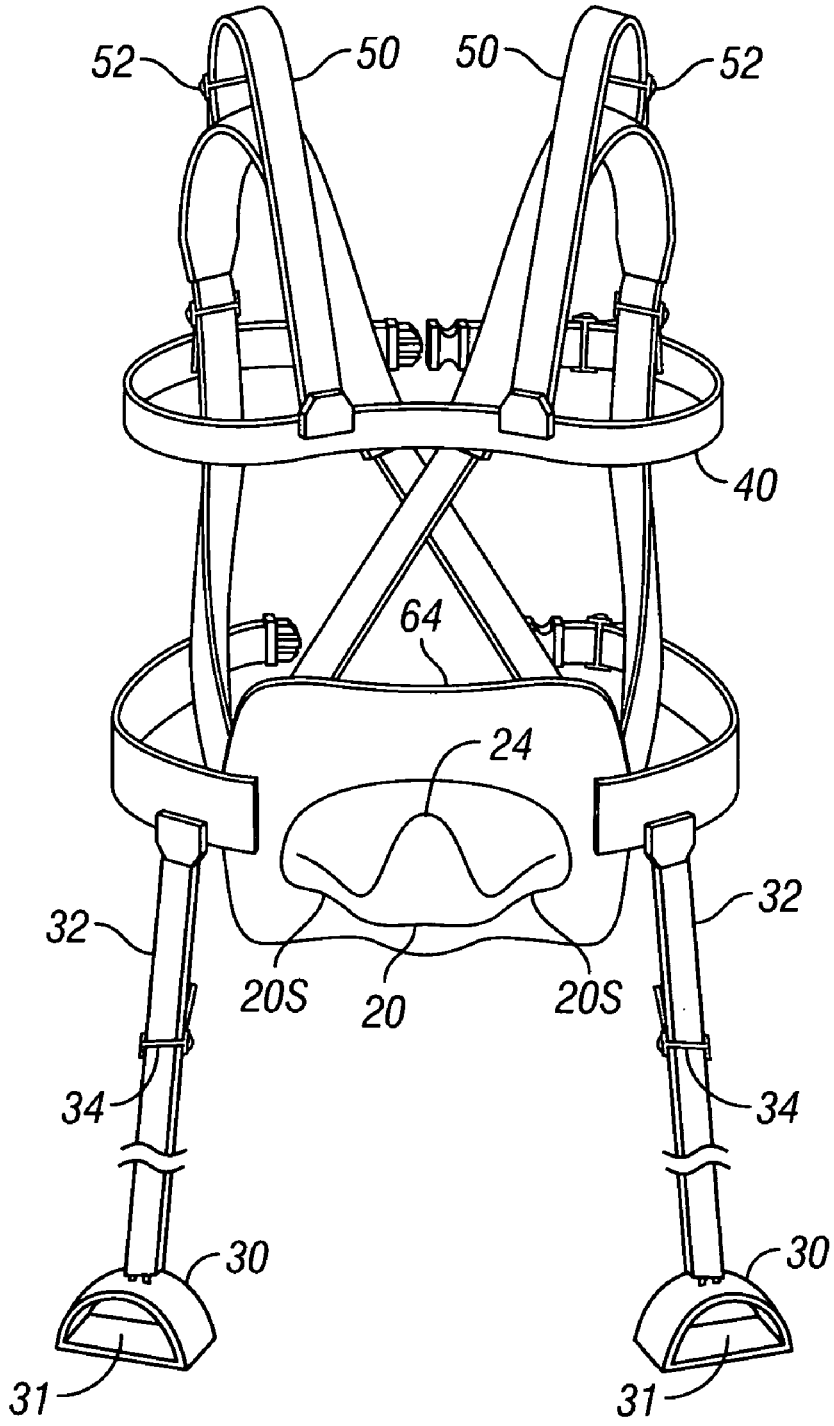
FIG. 4 is a rear elevational view thereof.

Referring now to FIG. 4, the stirrups 30 extend on either side of the saddle 20. Each stirrup has a main opening 31 which is sized to allow one of the two feet 97 of the child 90 to extend easily therein (as seen in FIG. 1). The stirrups are each supported from and attached to the waist belt 60 by a stirrup strap 32. Each stirrup strap has an adjustment buckle 34 for selectively adjusting the length of the stirrup strap 32 to accommodate different sized children.

Also indicated in FIG. 4, the minor shoulder straps 50 are each secured to the mid belt 40, which allows the child to be 'contained', with his head 96 extending between the minor shoulder straps 50, and the mid belt 60 extending under the arms 98 (as seen in use in FIG. 1). Provided that the minor shoulder straps 50 are located close enough together, so as to extend upon the shoulders ad immediately alongside the head 96, the child will be held securely in place. The minor shoulder straps 50 have adjustment buckles 52 which allow the minor shoulder straps 50 to be adjusted in length to assure that the child is securely held in place.

Referring again to FIG. 3, the mid belt 40 has both an adjustment buckle 42 and a mateable buckle 44. Accordingly, the mid belt 40 can be adjusted to the size of both the adult wearer 80 and child 90 that the mid belt 40 extends horizontally around, to ensure that the child 90 is held closely against the adult wearer 80. The mateable buckle 44 forms an important part of both donning the device 10 by the adult wearer 10, and allowing the child to "saddle up" onto the device 10, as will be described hereinafter. Note that the mid belt 40 is not directly attached to the major shoulder straps 70. As indicated in FIG. 3, during ordinary useage the major shoulder straps 70 extend through the space created by the mid belt 40.

Referring to FIGS. 1 and 4, the saddle 20 is configured with a main portion 22 which protrudes substantially horizontally rearward from the back plate 64, and a rear lip 24 which curves upwardly to help maintain the child 90 in the main portion 22. The saddle 20 has a pair of sides 20S, and a longitudinally extending ridge 26 which extends rearwardly on the main portion 22, centered between the sides. The saddle 20 curves downwardly from the ridge 26 toward the sides 20S, in an inverted parabolic shape, so as to match the contours between the legs of the child, and enhance the comfort thereof.

In use, the adult wearer first dons the carrying device 10 by placing his arms through the major shoulder straps 70 and positioning the back plate 64 against his lower back 85 and extending the waist belt 60 around his waist 84. The waist belt 60 is adjusted with its adjustment buckle 16, to snugly fit around the waist 84, and then the ends 61 and 62 are mated with its mateable buckle 14. Prior to the child 90 mounting the device 10, the mid belt 40 should be unfastened, and the mid belt 40 and minor shoulder straps should be flipped over the head of the adult wearer 80, so that they are in front 80F of the adult wearer 80. Preferably, the adult wearer 80 will crouch down to allow the child 90 to mount the device 10. The child 90 sits upon the saddle 20, with his legs extending on either side of the saddle 20, and extends each his feet through the main opening 31 of one of the stirrups 30. Then the mid belt 40 and minor shoulder straps 50 are flipped back over the head of the adult wearer 80 and the child 90, so that the mid belt 40 falls behind the back 90B of the child 90 and the minor shoulder straps 50 extend over the shoulders 92 of the child 90. The mid belt 40 is extended under the 98 arms of the child 90 and then under the arms 88 of the adult wearer 80 towards his front 80F, is adjusted with the adjustment buckle 42 to hold the child 90 close against his back 80B, and then is secured at his front 80F with the mateable buckle 44. If the adult wearer 80 is crouched during this process, the adult wearer 80 can then stand up, and comfortably carry the child.

In conclusion, herein is presented a carrying device, which is donned by an adult wearer, for allowing a child to be securely and comfortably carried in piggyback fashion. The invention is illustrated by example in the drawing figures, and throughout the written description. It should be understood that numerous variations are possible, while adhering to the inventive concept. Such variations are contemplated as being a part of the present invention.

What is claimed is:

1. A device for carrying a child piggyback upon an adult wearer, the adult wearer having a front, a back having a lower back, a waist, shoulders, arms, and a head, the child having a front, a back, shoulders, arms, a head, and feet, comprising:

a back plate, having an upper edge, a lower edge, a front, a rear, and a pair of sides, the back plate for resting against the lower back of the adult wearer;

a saddle extending rearwardly from the back plate, for allowing the child to sit thereon;

a waist belt, attached to the back plate and for selectively securing at the front of the adult wearer, for holding the back plate securely against the lower back of the adult wearer;

a pair of major shoulder straps, each having a pair of ends, both ends attached to the back plate, each shoulder strap having an apex which extends over one of the shoulders of the adult wearer;

a mid belt, for extending horizontally around both the adult wearer and child, under the arms of both the adult wearer and child; and a pair of minor shoulder straps, each minor shoulder strap attached at one end to the mid belt, and attached at an opposite end near the apex of one of the major shoulder straps, the minor shoulder straps for extending upwardly along the back of the child, over the shoulders of the child, and thereby, in conjunction with the mid belt, securely holding the front of the child against the back of the adult wearer.

2. The device for carrying a child as recited in claim 1, further comprising a pair of stirrups, each stirrup supported from the waist belt by a stirrup strap, the stirrups for accommodating and supporting the feet of the child while seated on the saddle.

3. The device for carrying a child as recited in claim 2, wherein the waist belt is attached at the rear of the back plate.

4. The device for carrying a child as recited in claim 3, wherein the back plate further has a sacrum extension, extending downwardly from the lower edge.

5. The device for carrying a child as recited in claim 4, wherein the saddle has a main portion which extends from the back plate, and a rear lip, for helping to retain the child on the main portion.

6. The device for carrying a child as recited in claim 5, wherein the main portion of the saddle has sides, and a longitudinally extending ridge extending rearwardly from the back plate; and wherein the main portion is curved downwardly from the ridge toward the sides.

7. The device for carrying a child as recited in claim 2, wherein the mid belt has a mateable buckle, and the mid belt has a pair of ends which may thereby be selectively separated, so that subsequent to the adult donning the device and the child mounting the device, the mid belt and minor shoulder straps may be passed rearwardly over the heads of both the adult wearer and child, such that the minor shoulder straps extend over the shoulders of the child toward the child's back, and the mid belt can be passed horizontally around toward the adults front and secured by securing the ends of the mid belt with the mateable buckle.

8. The device for carrying a child as recited in claim 7, wherein the waist belt has a mateable buckle for selectively securing the waist belt around the waist of the adult wearer.

9. The device for carrying a child as recited in claim 8, wherein the back plate further has a sacrum extension, extending downwardly from the lower edge.

10. The device for carrying a child as recited in claim 9, wherein the saddle has a main portion which extends from the back plate, and a rear lip, for helping to retain the child on the main portion.

11. The device for carrying a child as recited in claim 10, wherein the main portion of the saddle has sides, and a longitudinally extending ridge extending rearwardly from the back plate; and wherein the main portion is curved downwardly from the ridge toward the sides.

12. The device for carrying a child as recited in claim 11, wherein the shoulder straps cross each other between the upper edge of the back plate and their apexes.

* * * * *